United States Patent [19]

Yokoyama

[11] Patent Number: 4,655,529

[45] Date of Patent: Apr. 7, 1987

[54] JACK FOR TELEPHONE SET

[75] Inventor: Hideki Yokoyama, Tsu, Japan

[73] Assignee: Matsushita Electric Works, Ltd., Osaka, Japan

[21] Appl. No.: 755,901

[22] Filed: Jul. 17, 1985

[30] Foreign Application Priority Data

Jul. 25, 1984 [JP] Japan ..... 59-154501

[51] Int. Cl.[4] ..... H01R 13/506

[52] U.S. Cl. ..... 339/122 R; 339/126 R; 339/176 M; 339/206 R

[58] Field of Search ..... 339/176 M, 206 R, 206 P, 339/210 R, 210 M, 122 R, 123, 126 R

[56] References Cited

U.S. PATENT DOCUMENTS

| | | | |
|---|---|---|---|
| D. 270,995 | 10/1983 | Meyer | D8/9 |
| 4,040,699 | 8/1977 | Rasmussen | 339/176 M |
| 4,146,292 | 3/1979 | Garrett | 339/176 M |
| 4,224,485 | 9/1980 | Krumreich | 339/176 M |
| 4,274,691 | 6/1981 | Abernethy et al. | 339/206 R |
| 4,407,559 | 10/1983 | Meyer | 339/176 M |
| 4,451,106 | 5/1984 | Wiseheart et al. | 339/123 |
| 4,494,815 | 1/1985 | Brzostek et al. | 339/123 |

FOREIGN PATENT DOCUMENTS

| | | | |
|---|---|---|---|
| 125606 | 2/1974 | Japan . | |
| 2020493 | 11/1979 | United Kingdom | 339/176 M |

*Primary Examiner*—John McQuade

*Attorney, Agent, or Firm*—Burns, Doane, Swecker & Mathis

[57] ABSTRACT

A jack for telephone sets comprises a casing of an insulating material and including body and cover parts dismountably coupled together for enclosing therein a jack body including a contact block with which terminal blades of a plug received through a mounting hole of the casing are contactable, and the casing further has means provided on the outer surface for engaging the jack to any generally available mounting frame for wiring appliances to allow the jack to be easily mounted thereto together with the wiring appliances and the like for other electric instruments.

5 Claims, 22 Drawing Figures

10
160

160
161

160
161
162
163

160
161
162
162
163
163

160'
161'
161'
162'

100
150
171
160'
170

JACK FOR TELEPHONE SET

TECHNICAL BACKGROUND OF THE INVENTION

This invention relates to jacks for telephone sets and, more particularly, to a jack for receiving a cord-end plug of telephone set and made mountable onto general wall mounting frames to which such wiring appliances as receptacles, switches and the like are mounted.

The jackes of the kind referred to are generally mounted to a wall surface and include connecting terminals for interconnecting cord end plug of movable telephone set of plug-in telephone system or the like to telephone circuit wires.

DISCLOSURE OF PRIOR ART

Such telephone jacks as above have been installed on a room wall or the like position independently separately from the wiring appliances, so that house wirings for telephone system and electric supply have had to be made complicated, and there have been suggested certain types of the jacks made mountable to the wall mounting frame for the wiring appliances concurrently therewith.

However, these known jacks arranged for the concurrent mounting with the wiring appliances have been requiring new design and manufacture of both the mounting frame and its decorative cover plate or at least the mounting frame for adaption to the concurrent mounting, which have been causing manufacturing process to become complicated. In the event where, in particular, the thus newly manufactured cover plate is different in size from the ones already installed exclusively for use with the wiring appliances, there has arisen a problem that their appearance was out of harmony. In addition, when two or more of the telephone set jacks are required to be mounted together with the wiring appliance or appliances, the mounting frame as well as its decorative cover plate have had to be prepared taking well into consideration the size, shape and so on of the wiring appliances, and further complicated manufacturing process was called for. For the prior art describing such jacks as above, there may be enumerated Japanese Utility Model Appln. Laid-Open Publication No. 125606/1974 of K. Tanaka et al and U.S. Pat. No. Des. 270,995 of D. Meyer.

TECHNICAL FIELD OF THE INVENTION

A primary object of the present invention is, therefore, to provide a jack for telephone sets which can be mounted concurrently with wiring appliances on an existing mounting frame generally available, the concurrent mounting of which being possible even for at least two of the jacks, without requiring any substantial modification of decorative cover plate of such mounting frame, that is, employing substantially the same decorative cover plate as the one exclusively for use with the wiring appliances.

According to the present invention, this object can be realized by providing a jack for telephone sets which comprises a casing made of an insulating material and including body and cover parts coupled together, the casing being provided with a mounting hole for receiving a cord end plug of telephone set, a jack body provided within the body part and having contact block with which terminal blades of the plug received are contactable, and means provided on the casing for engaging the jack to a generally available wiring-appliance mounting frame.

Other objects and advantages of the present invention shall become clear from the following description of the invention detailed with reference to preferred embodiments illustrated in accompanying drawings.

Figure 5:
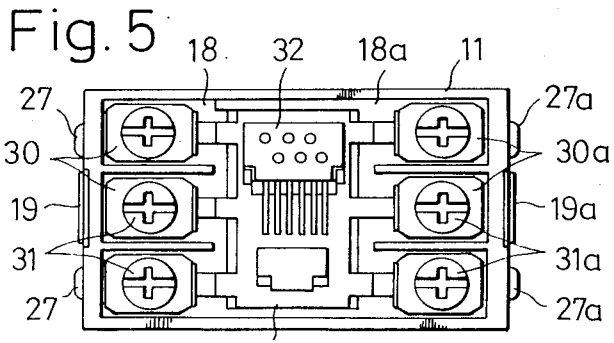
FIG. 5 is a rear side view as magnified of the jack of FIG. 3.
Figure 8:
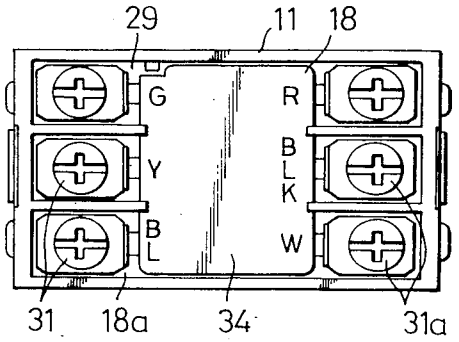
FIG. 8 is a rear side view as magnified of the jack of FIG. 3 with a rear cover plate attached.

While the present invention shall now be described with reference to the preferred embodiments shown in the drawings, it should be understood that the intention is not to limit the invention only to the particular embodiments shown but rather to cover all alterations, modifications and equivalent arrangements possible within the scope of appended claims.

DISCLOSURE OF PREFERRED EMBODIMENTS

Figure 1:
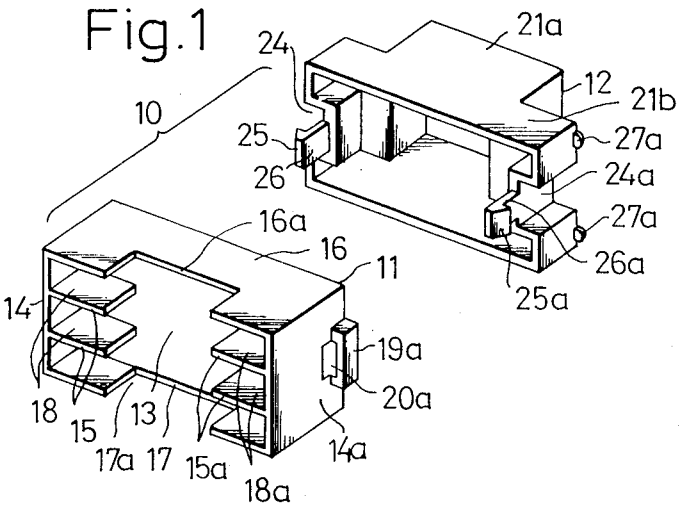
FIG. 1 is perspective view as disassembled of a casing employed in a first embodiment of a jack for telephone set according to the present invention.
Figure 4:
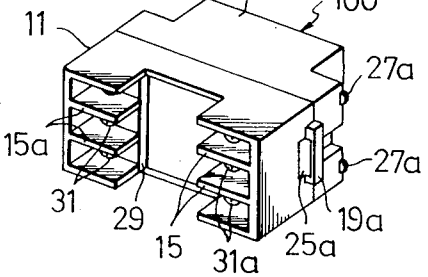
FIG. 4 is a perspective view of the jack of FIG. 3 as viewed from the outer side than that of FIG. 3.
Figure 3:
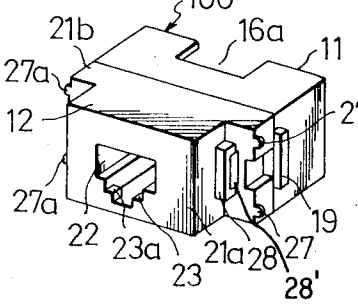
FIG. 3 is a perspective view of the jack in the first embodiment of the present invention, employing the casing of FIG. 1 shown here as assembled.

Referring to FIGS. 1 to 4, a casing 10 employed in the jack for telephone set according to a first embodiment of the present invention is made of an insulating material and comprises a body part 11 and a cover part 12. The body part 11 is formed in a rectangular box shape having a hollow space 13 defined by longitudinal end walls 14 and 14*a* respectively having a pair of spaced partitions 15 or 15*a* extending horizontally inwardly, and upper and lower walls 16 and 17 to which the partitions 15 and 15*a* are parallel, so that a cord end plug of a telephone set can be inserted into the space 13. Inward extended ends of the partition walls 15 and 15*a* are aligned vertically with side edges of notches 16*a* and 17*a* provided in the upper and lower walls 16 and 17 and, in the illustrated embodiment, each pair of the partitions 15 or 15*a* defining one of three partition chambers 18 or 18*a* inside each of the end walls 14 and 14*a*. These end walls 14 and 14*a* are provided respectively on their outer faces with engaging projections 19 and 19*a* as seen in FIGS. 1 and 3 and fitting holes 20 and 20*a* are made in the walls 14 and 14*a* adjacent these projections (only one of which holes is shown in the drawings.)

Figure 2:
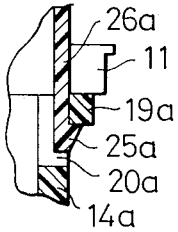
FIG. 2 is a fragmentary sectional view showing a coupling state between body and cover parts of the casing of FIG. 1.

On the other hand, the cover part 12 is formed to comprise respectively rectangular front and rear parts 21*a* and 21*b*, the latter of which is hollow and dimensioned to correspond to the body part 11 while the former of which is shorter in the longitudinal direction. The front part 21*a* is formed to have an axial mounting hole 22 (FIG. 3) extending perpendicularly with respect to the longitudinal direction and opened on the front face with a shape corresponding in cross section to the outline of the telephone set plug. In the illustrated embodiment, the mounting hole 22 is substantially T-shaped in cross section and provided only at the entrance of its lower side corners with inward projections 23 and 23*a* as seen in FIG. 3. The rear part 21*b* is provided at its longitudinal end walls with recesses 24 and 24*a* respectively extending in the axial direction so that, when the cover part 12 is fitted to the body part 11, inner bottom walls of the recesses 24 and 24*a* will be positioned slightly inward from the end walls 14 and 14*a* of the body part 11. Further, the rear part 21*b* is provided at the rear end edges of the inner bottom walls of the recesses 24 and 24*a* with hooks 25 and 25*a* made at tip ends of fitting arms 26 and 26*a* extending rearward in the axial direction from the bottom walls of the recesses 24 and 24*a* so that, when the cover part 12 is fitted to the body part 11, the hooks 25 and 25*a* will fit into the fitting holes 20 and 20*a* made in the body part 11 to engage with the engaging projections 19 and 19*a*, as shown in FIG. 2. The rear part 21*b* is further provided at the frontward edges with two pairs of vertically spaced first engaging projections 27 and 27*a* (see FIG. 3), while the front part 21*a* is provided at rearward ends of its longitudinal end walls with second engaging projections 28 and 28*a* (only one of which is seen in the drawings, specifically FIG. 3) which have respectively an engaging recess 28', preferably.

Referring now to the jack in the first embodiment by references to FIGS. 3 to 8, a terminal plate 29 is assembled in the casing 10 as firmly held between the body and cover parts 11 and 12 when they are coupled together. The terminal plate 29 carries two rows of terminal metal fittings 30 and 30*a* which are respectively located within the partition chambers 18 and 18*a* inside both longitudinal end walls 14 and 14*a* of the body part 11, and terminal pins 31*a* and 31*b* are screwed into the terminal fittings 30 and 30*a*. Disposed between the rows of the terminal fittings 30 and 30*a* within the body part 11 in its longitudinal direction is a jack body 32 having contact pins 33 which extend diagonally rearward when the jack body 32 is mounted in the body 11, and these contact pins 33 are respectively connected to corresponding ones of the terminal fittings 30 and 30*a* in manner known per se while details of the connection are not shown. Further, a rear cover plate 34 is fitted to the central opening on the rear side of the body part 11 to cover the jack body 32 therein, while exposing the terminal pins 31 and 31*a* adjacent which the plate 34 carries such two sets of alphabetic marks as G, Y, BL and R, BLK, W preferably in colors for easy connection of telephone circuit wires having insulating coats of such different colors as green, yellow, blue and red, black, white to corresponding ones of the terminal pins 31 and 31*a*.

Figure 9:
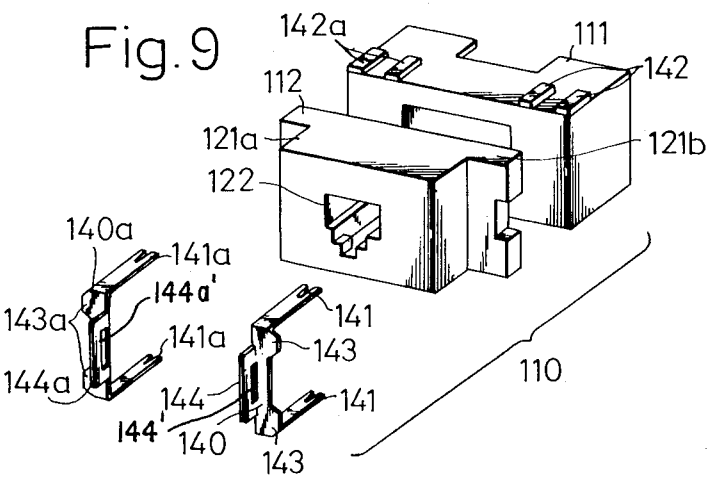
FIG. 9 is a perspective view as disassembled of a casing employed in a second embodiment of the jack according to the present invention.
Figure 10:
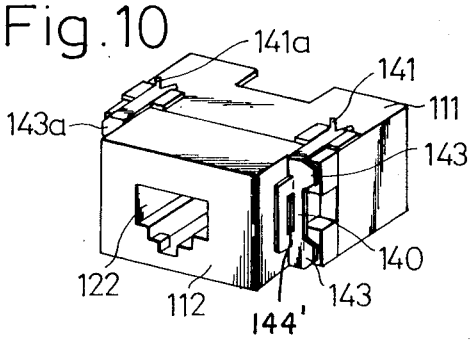
FIG. 10 is a perspective view as assembled of the casing of FIG. 9.
Figure 6:
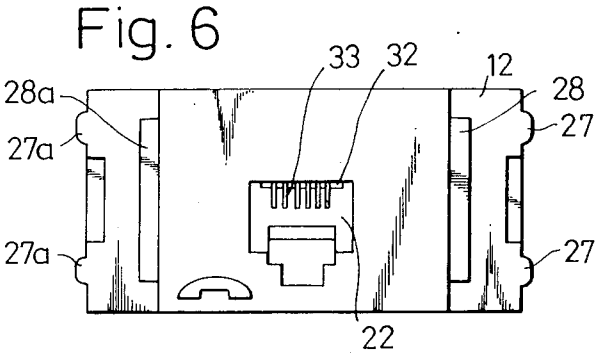
FIG. 6 is a front side view of the jack of FIG. 3.
Figure 7:
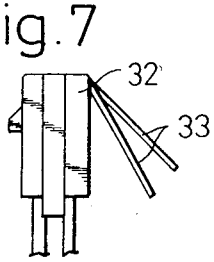
FIG. 7 is a lateral side view of a jack body to be assembled in the jack according to the present invention.

Referring next to FIGS. 9 and 10 showing a casing 110 of a telephone set jack of another embodiment of the present invention, wherein body and cover parts 111 and 112 are assembled together by means of fastening clamps 140 and 140*a*, instead of the hook and engaging-hole arrangement of the foregoing first embodiment. The clamps 140 and 140*a* are respectively U-shaped to have mutually resiliently separable leg portions respectively having forked ends 141 and 141*a*. On the other hand, the body part 111 is provided adjacent each front end corner of the top and bottom surfaces with two pairs of engaging projections 142 and 142*a* (only the pairs mounted on the top surface of the body part 111 are shown in the drawings) respectively spaced from each other. In assemblying the body and cover parts together, the clamps 140 and 140*a* are first fitted over the cover part 112 with the middle body portion of each clamp placed on the top surface of a rear portion 121*b* of the cover part 112, then the leg portions are respectively fitted resiliently between the pair of the engaging projections 142 or 142*a*, and the forked ends 141 and 141*a* are opened to firmly engage with the rear edges of the engaging projections 142 and 142*a*, whereby the cover part 112 is firmly coupled to the body part 111.

The clamps 140 and 140*a* are provided at their middle body portions with engaging projections 143 and 143*a* which extend perpendicularly to their leg portions, i.e., along the top surface of the rear part 121*b* of the cover part 112, the projections 143 and 143*a* performing the same function as the first engaging projections 27 and 27*a* in the first embodiment, and with engaging lugs 144 and 144*a* extending forwardly along the longitudinal end walls of the front part 121*a* and performing the same function as the second engaging projections 28 and 28*a* in the first embodiment. The lugs 144, 144*a* include recesses 144', 144'*a*. Other arrangement and operation are substantially the same as those of the first embodiment.

Figure 12:
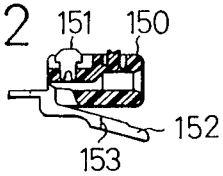
FIG. 12 is a vertically sectioned view of the plug of FIG. 11.
Figure 11:
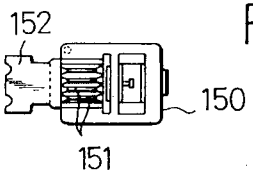
FIG. 11 is a top plan view of a cord end plug of telephone set to which the jack of the present invention is applied.

A plug 150 connected to a telephone set cord as shown in FIGS. 11 and 12 is suitably employed for the telephone jacks shown in FIGS. 1 to 8 and FIGS. 9 and 10. The plug 150 is insertable into the mounting hole 22 or 122 of the casing 10 or 110, the hole 122 being similar to the hole 22, so that contacts 151 of the plug will come into contact with the respective terminal pins 33 of the jack body 32. In this case, the contacts 151 are mutually spaced and insulated preferably by means of partitions provided between the respective contacts 151. The plug 150 further includes a resilient engaging arm 152 which extends forwardly and has engaging hooks 153 which are internally engageable with the inward projections 23 and 23*a* in the mounting hole 22 when the plug 151 and arm 152 are fully inserted into the hole, so as to prevent the plug from being easily pulled out of the hole, whereas, when the arm 152 is depressed against its resiliency and the plug is pulled, the hooks 153 are disengaged from the projections 23 and 23*a* to allow the plug 150 to be drawn out of the mounting hole of the jack.

Figures 13, 14, 15, 16:
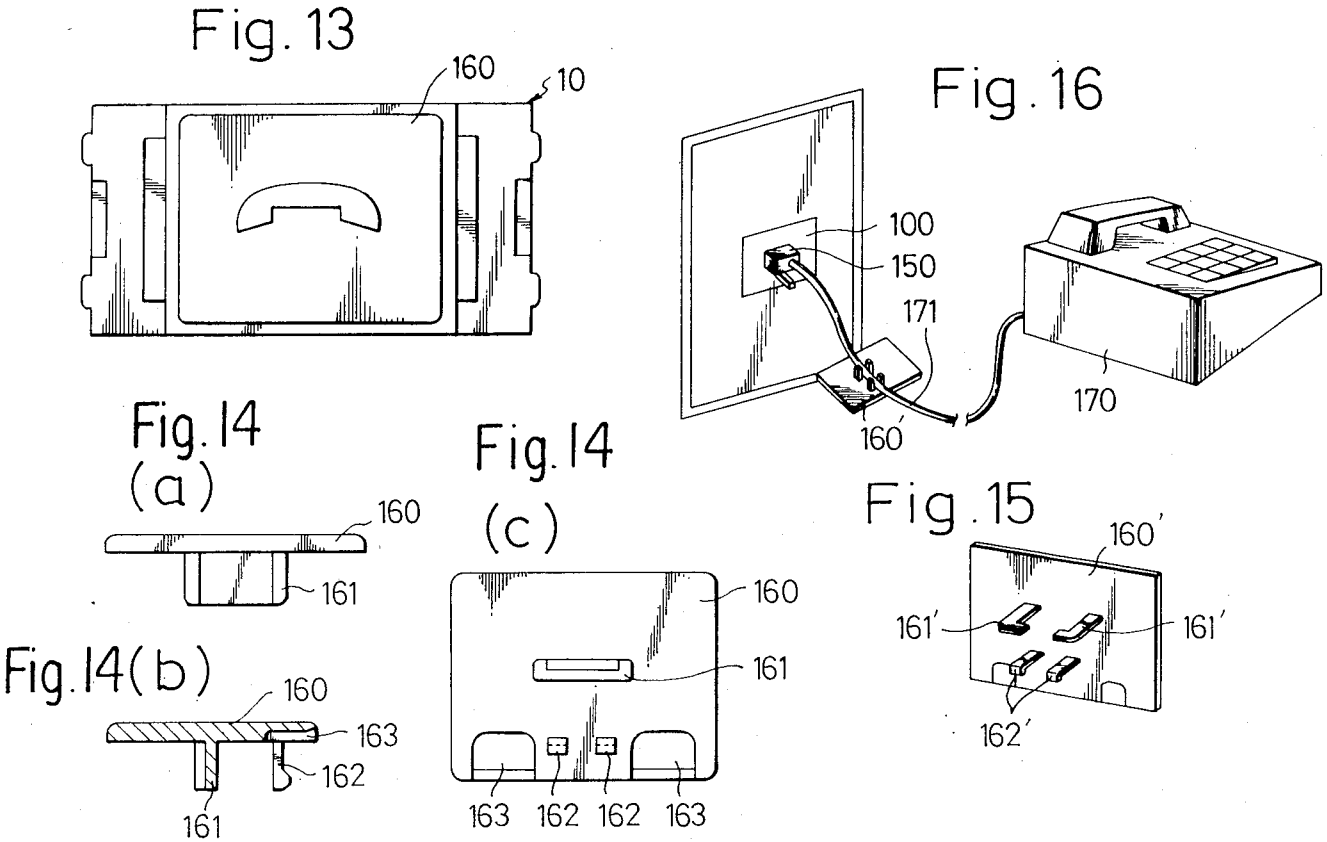
FIG. 13 is a front side view showing a state in which a decorative cover plate is fitted to the jack in either the first or second embodiment of the present invention.
FIG. 14 in part (*a*) shows a bottom plan view of the cover plate shown in FIG. 13, in part (*b*) shows a vertically sectioned view of the cover plate of FIG. 13, and in part (*c*) shows a rear side view of the cover plate of FIG. 13.
FIG. 15 is a perspective view as seen from the rear side of a cover plate in a modified form from that of FIG. 13.
FIG. 16 is an explanatory view for a state in which the cover plate of FIG. 15 is removed from the jack and held on a cord of a telephone set of which the plug is inserted into the jack mounted to a mounting frame.

When the telephone jack is not in use, a face cover plate 160 may be fitted thereto to close the mounting hole 22 or 122. Referring to FIGS. 13 and 14, the face cover plate 160 is provided on the rear side with a plate-shaped holding leg 161 and a pair of rod-shaped holding legs 162, the former leg 161 being engageable in the upper wider portion of the T-shaped mounting hole 22 or 122 and the latter legs 162 in the lower narrower portion of the hole of the jack, so that they can frictionally engage with the upper and lower surfaces of the mounting hole 22 or 122 of the jack to allow the face cover plate 160 to be stably mounted onto the jack. Also on the rear side, the cover plate 160 has a pair of recesses 163 opened at the lower end edge so that the tip end of a screw driver may be inserted into these recesses 163 for easy dismounting of the cover plate from the jack. The face cover plate 160 functions to block intrusion of dust etc. into the jack.

In a modified face cover plate 160' shown in FIGS. 15 and 16, a pair of L-shaped holding legs 161' are provided instead of the plate-shaped leg 161, with their bent ends disposed to oppose each other and to define a gap between them enough for holding a cord 171 of a telephone set 170. This allows that, when the cover plate 160' is dismounted from the jack 100 for mounting the plug 150, the cover plate 160' may be held on the cord 171 as shown in FIG. 16 for ready re-mounting without being caused to be missing.

Figure 18:
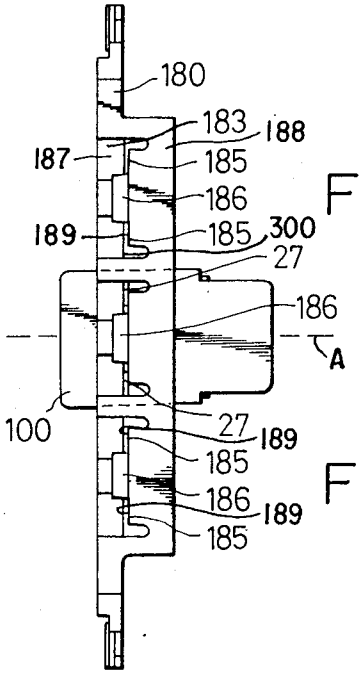
FIG. 18 is a side elevation of the jack and frame of FIG. 17.
Figure 17:
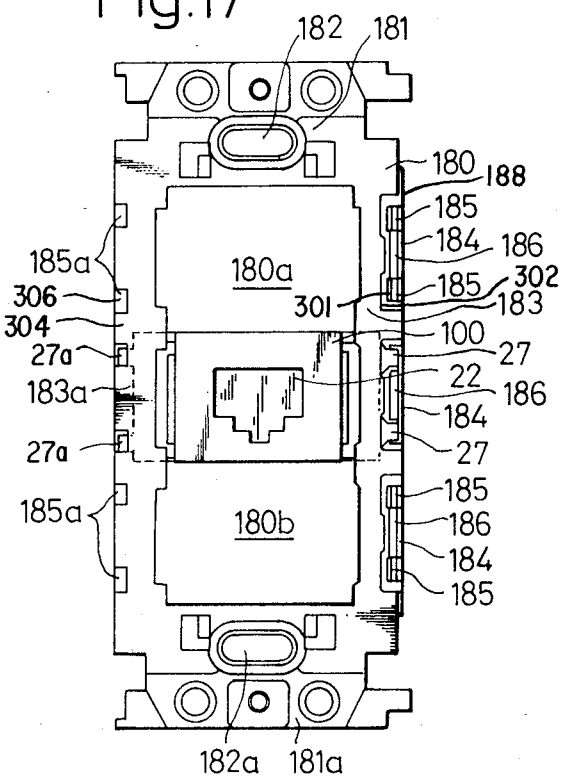
FIG. 17 is a front plan view showing a state in which the jack according to the present invention is mounted to the middle position of a generally available mounting frame.
Figure 22:
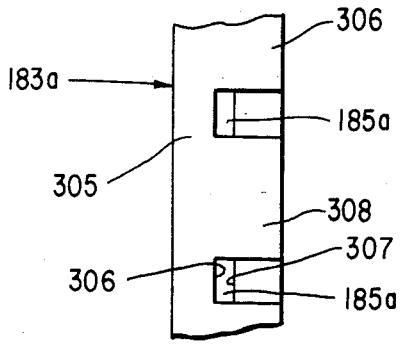
FIG. 22 is a fragmentary side view of a left side portion of a mounting frame depicted in FIGS. 17 and 18.

The telephone jack 100 of such arrangement as has been disclosed is smoothly mountable to any generally available mounting frame for the wiring appliances. FIGS. 17 and 18 show a state in which the jack 100 is mounted to a well known mounting frame 180 which is adapted to a concurrent mounting thereto of three wiring appliances. The mounting frame 180 shown here is made of a synthetic resin to comprise upper and lower side portions 181 and 181*a* respectively provided in their centers with each of through-holes 182 and 182*a* through which screws can be passed for securing the mounting frame to a wall or the like, and right and left side portions 183 and 183*a* connecting both ends of the upper and lower side portions 182 and 182*a*. Each side portion includes a front strip 187 and a back strip 188. The back strip 188 of the right side portion 183 includes three vertically equally spaced side holding plate members 184. Each holding plate member comprises a release projection 186 and a pair of shoulders 189 disposed above and below the release projection. The plane of each shoulder 189 is spaced from a plane of a backside 300 of the front strip in a direction parallel to a horizontal axis A of the frame to define a pair of holding holes 185 above and below a release projection 186. Also, the plane of an inner wall 301 of each holding plate member is spaced from the plane of an opposing wall 302 of the first strip 187 in a direction perpendicular to the axis A.

The left side portion 183*a* includes a front strip 304 and a rear strip 305. The plane of a front surface 306 of the rear strip is spaced from the plane of a rear surface 307 of the front strip 304 in a direction parallel to the axis A so as to define left side holding holes 185*a*. The front and rear strips are interconnected by tabs 308.

The casing 10 is installed by first inserting the engaging projections 27*a* on one side thereof into two of the left side holding holes 185*a*. Then, the casing is rotated in a horizontal plane about those inserted projections 27*a* as fulcrums, simultaneously as the holding plate 184 is being flexed outwardly (e.g., by a screwdriver). When the projections 27 become registered with the holding holes 185, the holding plate is released to snap back to a position in which the shoulders 189 are situated behind the projections to lock the latter in place.

In other words, the telephone jack 100 can be easily mounted on this mounting frame 180 by inserting initially, for example, the pair of left engaging projections 27*a* on one longitudinal end edge of the cover part 12 of the casing 10 into the pairs of holding holes 185*a* in the left side portion 183*a* of the mounting frame 180, and then fitting the other side pairs of the engaging projections 27 of the cover body 12 into the holding holes 185 in the right side portion 183 with the side holding plate member 184 urged to be outwardly bent by means of a lever action of a screw driver inserted between the release projection 186 and the side portion 183. When this procedure is carried out in opposite to the above, the jack 100 can be dismounted from the mounting frame 180. The thickness of the mounting frame 180 in the direction of axis A is less than the longitudinal length of the casing along the axis A (see FIG. 18).

The mounting frame 180 may be further provided with projections (while not shown) which can come into engagement with the recesses in the second engaging projections 28 and 28*a* of the cover part 12 of the casing 10 to increase its holding force. Also, in the present invention, there may be employed such a mounting frame that has only projections which are engageable in the recesses 28' or 144', 144'*a* of the engaging projections 28 and 28*a*.

Since the jack comprising the casing 110 of FIGS. 9 and 10 also has the engaging projections 143 and 143*a* and engaging lugs 144 and 144*a* having the same function as the first and second engaging projections 27, 27*a* and 28, 28*a* of the jack of FIGS. 1 to 8, it will be appreciated that the jack of FIGS. 9 and 10 can be smoothly mounted onto the mounting frame 180 of FIGS. 17 and 18 in the similar manner to the above.

Figure 19:
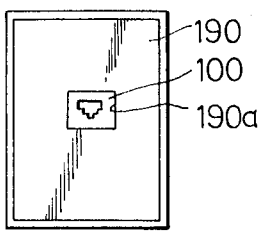
FIGS. 19 to 21 are front side views showing examples in which the decorative cover plates in three different patterns are fitted to the mounting frame of FIG. 17.
Figure 20:
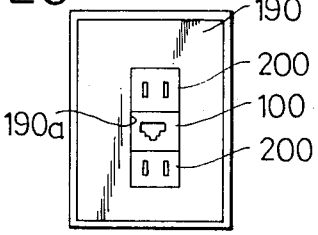

When a single telephone jack is used as mounted on the mounting frame of FIGS. 17 and 18, a decorative cover plate 190 having in its center an opening 190*a* through which the mounting hole of the jack is accessible is mounted on the mounting frame as shown in FIG. 19. When two receptacles or the like wiring appliances are concurrently mounted in remaining open regions 180*a* and 180*b* of the mounting frame 180 of FIG. 17 other than the region in which the jack 100 is mounted, which being the best mode for carrying out the invention, the decorative plate 190 having an enlarged opening 190*a* to allow also the receptacles 200 disposed above and below the jack 100 to be accessible is mounted on the mounting frame as shown in FIG. 20. Further, FIG. 21 shows a state in which three of the jacks 100 are exclusively mounted on the mounting frame.

Figure 21:
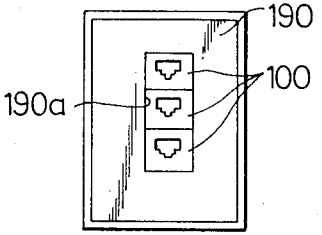

It will be appreciated that the wiring appliances may be mounted to the mounting frame in any other arrangement than that of FIGS. 19 to 21, and that the mounting frame for the telephone jacks according to the present invention is not restricted to the one designed for the mounting of three wiring appliances as in FIGS. 17 and 18, but a frame for more than four appliances or less than two may be used.

The jacks for telephone sets of the present invention as has been referred to are advantageous in that the jacks can be mounted in particular to any one of the generally available mounting frame independently or, if required, concurrently with any other wiring appliances, whereby the convenience in use is made very high and the use of the decorative cover plate harmonized in the appearance with all other cover plates for already installed other wiring appliances can be allowed.

What is claimed as our invention is:

1. A jack for a telephone set comprising a casing made of an insulating material and including body and cover parts coupled together, said casing having a mounting hole for a plug connected to a cord of said telephone set, a jack body housed within the casing and having contact means contactable with contacts of said plug inserted into said mounting hole, connecting terminals arranged within the casing and connected to said contact means of said jack body, and engaging means provided on the casing for connecting the jack to a mounting frame, said engaging means comprising projections provided on opposing side portions of said casing and extending in opposite laterally outward directions to be engageable in holding holes provided in the mounting frame, said body and cover parts of said casing being coupled together by means of a pair of clamps, said projections being provided on said clamps.

2. A jack according to claim 1 in combination with said mounting frame, said casing including a pair of side portions disposed on opposite sides of said mounting hole, said projections extending outwardly from said side portions in directions lateral of a longitudinal axis of said mounting hole, said mounting frame including a pair of side walls spaced apart to define an opening therebetween sized to receive said casing in the direction of said longitudinal axis, said mounting frame having a thickness in a direction parallel to said longitudinal axis which is less than the longitudinal length of said casing, each of said side walls including a holding hole sized to receive said projections of said casing, one of said side walls being yieldable laterally outwardly to permit one of said projections to enter a holding hole of said yieldable side wall after the other projection has been inserted into said holding hole of said other side wall.

3. A jack for a telephone set in combination with a mounting frame, said jack comprising a casing made of an insulating material and including body and cover parts coupled together, said casing having a mounting hole for a plug connected to a cord of said telephone set, a jack body housed within the casing and having contact means contactable with contacts of said plug inserted into said mounting hole, connecting terminals arranged within the casing and connected to said contact means of said jack body, and engaging means provided on the casing for connecting the jack to said mounting frame, said engaging means comprising projections provided on opposing side portions of said casing and extending in opposite laterally outward directions to be engageable in holding holes provided in said mounting frame, said casing including a pair of side portions disposed on opposite sides of said mounting hole, said projections extending outwardly from said side portions in directions lateral of a longitudinal axis of said mounting hole, said mounting frame including a pair of side walls spaced apart to define an opening therebetween sized to receive said casing in the direction of said longitudinal axis, said mounting frame having a thickness in a direction parallel to said longitudinal axis which is less than the longitudinal length of said casing, each of said side walls including a holding hole sized to receive said projections of said casing, one of said side walls being yieldable laterally outwardly to permit one of said projections to enter a holding hole of said yieldable side wall after the other projection has been inserted into said holding hole of said other side wall.

4. A jack according to claim 3, wherein said casing includes recesses spaced from said projections in the direction of a longitudinal axis of said mounting hole for receiving projections of a mounting frame.

5. A jack according to claim 4, wherein there is a pair of said projections disposed on each said side portion.

* * * * *